United States Patent [19]

Brennan

[11] 4,079,658

[45] Mar. 21, 1978

[54] VEHICLE GUN CONTROL HAVING DECK AVOIDANCE FEATURE

[75] Inventor: Donald Francis Brennan, Dalton, Mass.

[73] Assignee: The United States of America as represented by the Secretary of the Army, Washington, D.C.

[21] Appl. No.: 745,280

[22] Filed: Nov. 26, 1976

[51] Int. Cl.[2] ..... F41F 21/00

[52] U.S. Cl. ..... 89/41 C

[58] Field of Search ..... 89/41 C, 134

[56] References Cited

U.S. PATENT DOCUMENTS

| | | | |
|---|---|---|---|
| 2,628,535 | 2/1953 | Terwilliger et al. | 89/41 C |
| 3,731,589 | 5/1973 | Pfeiffer et al. | 89/41 C |

*Primary Examiner*—Stephen C. Bentley

*Attorney, Agent, or Firm*—Peter A. Taucher; John E. McRae; Nathan Edelberg

[57] ABSTRACT

Control circuitry for a gun mounted in a vehicle turret that is non-symmetrical relative to the vehicle front and rear ends. The gun can slew across the front and side areas of the vehicle at a minimum elevation of −20°, but due to the turret-vehicle orientation the gun is restricted to a minimum elevation of −7° while slewing across the vehicle rear end. Should the gun be slewing toward the rear end of the vehicle while tracking a target at a level below the −7° elevation, then in that event anticipating circuitry in the control system will automatically raise the gun to a safe elevation while the gun is passing over the vehicle rear end. The vehicle rear end is hereafter referred to as an avoidance zone.

3 Claims, 2 Drawing Figures

VEHICLE GUN CONTROL HAVING DECK AVOIDANCE FEATURE

The invention described herein may be manufactured, used, and licensed by or for the Government for governmental purposes without payment to me of any royalty thereon.

BACKGROUND AND SUMMARY OF THE INVENTION

In some military vehicles the main gun is mounted in a turret which rotates around a vertical axis in the azimuth plane; the gun is mounted on the turret for swinging movement in a vertical elevational plane. The gun is trained on the enemy target (airborn or land) by combinational movements of the turret and gun in the azimuth and elevation planes.

In one particular vehicle the minimum gun depression angle is −20° except over the rear end of the vehicle where the elevation angle is restricted to −7°. An aim of this invention is to provide circuitry that enables the gunner to have tracking capability in the low level zones between −7° and −20° except in the so-called "avoidance zone" defined by the vehicle rear end. As the gun approaches the avoidance zone a "pop-up" command is generated by circuit components that respond to azimuth train velocity and gun position. The pop-up command is applied to relay contacts shunted around resistances in a potentiometer that is responsive to gun motion in the elevational plane.

Potentiometer voltage signal is summed with an elevation tachometer-derived voltage to limit the normal maximum elevation rate from 90°/sec at −5° to 0°/sec at −20 ° elevation. In the avoidance zone this limit is modified to 90°/sec allowable at +18° and 0°/sec at −7°. This function is accomplished by switching the voltage levels on the elevation position limit potentiometer as a function of azimuth position and velocity.

As the gun approaches avoidance zone 14 below the −7° elevation it is necessary for safety reasons to limit possible azimuthal acceleration inputs by the gunner. The circuitry senses and stores the difference between the so-called "safe" azimuthal rate and the actual azimuth rate. When a pop-up command is issued the stored difference provides a signal that limits the azimuthal velocity to a safe value until the gun is elevated to the −7° elevation.

THE DRAWINGS

Figure 1:
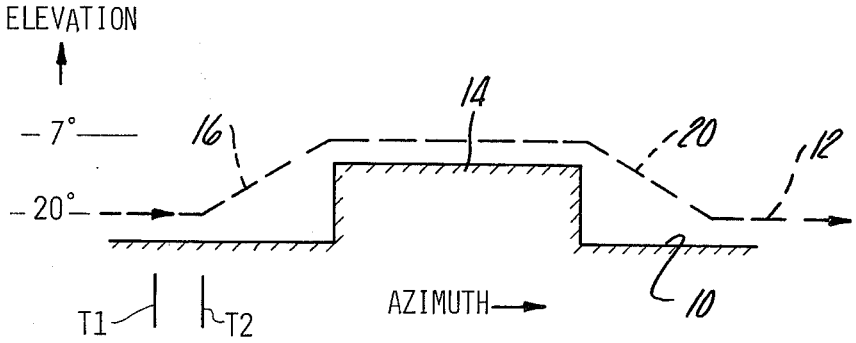
FIG. 1 is a schematic profile illustration of a vehicle deck and the path taken by a gun to avoid striking a rearwardly projecting deck area.

FIG. 1 is an unfolded view showing the deck area 10 of a military vehicle, and the path 12 taken by the gun as it moves over a deck obstruction 14 resulting from turret location and/or deck contour at the vehicle rear end. In the major portion of its travel the gun has a maximum declination of 20°; in the so-called avoidance zone 14 the gun has a maximum declination of only 7°. When the gun is slewing across zone 14 toward a target below −7° and above −20° elevation the gun must be elevated, as at 16, and subsequently depressed, as at 20. The present invention relates to circuitry for automatically issuing a "pop-up" command to the elevation control system before the gun actually reaches the obstruction. The circuitry preferably includes components that time the pop-up command inversely accordingly to the azimuth slewing rate. For example, if the azimuth slew rate is relatively high the pop-up command might issue at time T1, whereas at lower azimuth slew rate the pop-up command might issue at a later time T2. The circuitry preferably operates in either direction (clockwise or counterclockwise).

Figure 2:
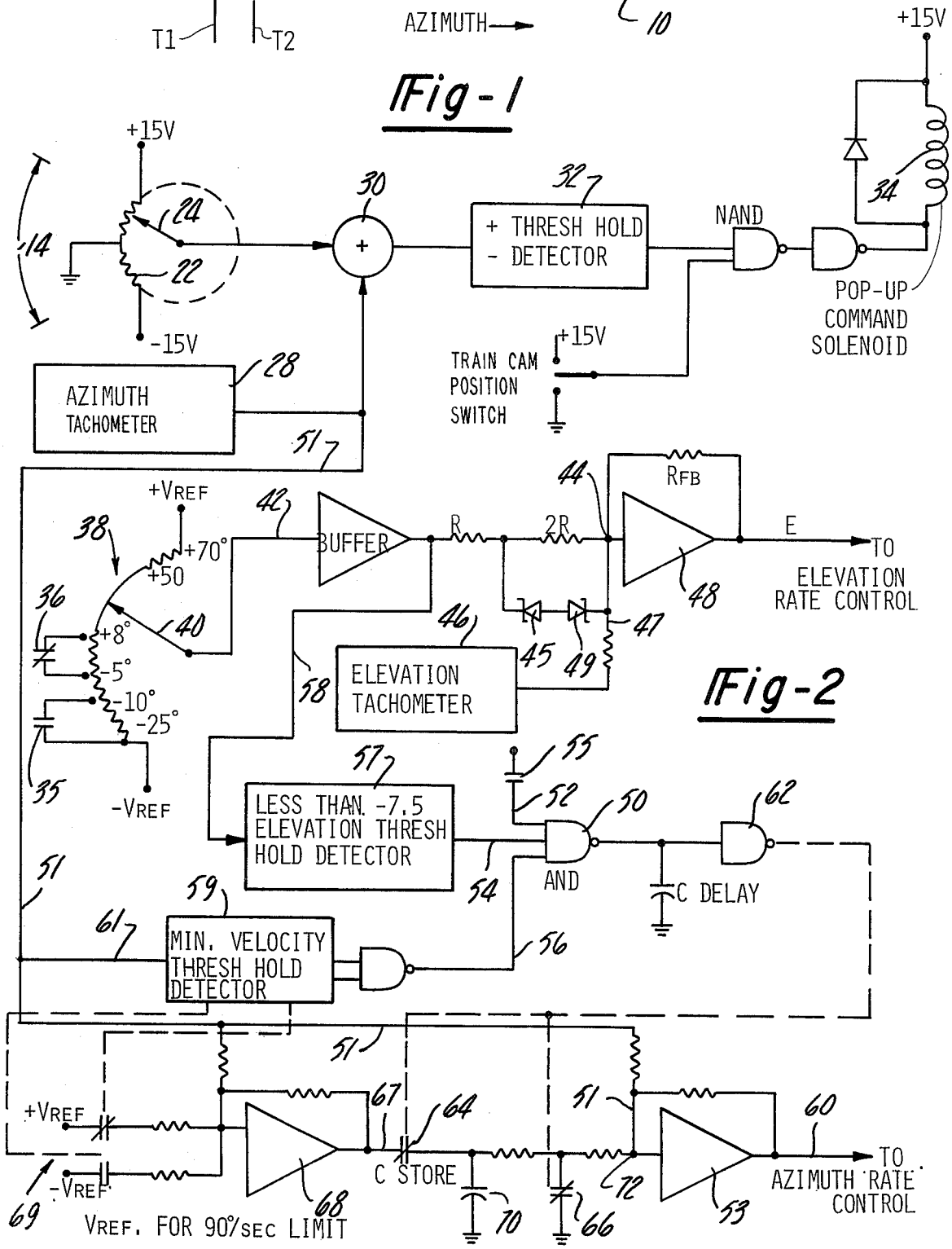
FIG. 2 is a block diagram of sensor-control circuitry embodying this invention.

In FIG. 2 of the drawings there is shown a control system that includes a potentiometer 22 having a rotary slider 24 synchronized with the turret, either continuously or at least while the gun is in the vicinity of avoidance zone 14. The slider or wiper arm 24 is arranged to move up to and across the miniature simulated avoidance zone provided by potentiometer 22.

Potentiometer 22 has a greater length than the simulated avoidance zone 14 so that slider 24 begins to transmit a voltage signal before it reaches zone 14. Slider 24 and azimuth velocity-sensing tachometer 28 provide separate voltage inputs to a summing junction 30 which forms the input for a velocity threshhold detector 32. Detector 32 output signal controls energizer current for a "pop-up" command solenoid 34. The threshhold detector is a voltage sensitive device that tells solenoid 34 when to issue the "pop-up" command; if the azimuth train rate is high, more voltage is coming from tachometer 28 than if the rate is low. Under a high azimuth train rate condition less voltage is required from the position potentiometer 22 to reach a predetermined threshold level; thus the "pop-up" command will be issued at a smaller train angle or farther away from the obstruction 14 than if the train rate were lower. In other words, the slower the train rate, the closer the gun may come to the obstruction before solenoid 34 issues the "pop-up" signal. The + and − signs are applied to detector 32 to denote operability in clockwise and counterclockwise directions of slider 24. Potentiometer 22 is connected to separate voltage sources at its opposite ends to provide an appropriate voltage signal in either gun-approach direction.

The pop-up command solenoid 34 controls normally open contacts 35 and normally closed contacts 36 located as shunts around selected resistive sections of a potentiometer 38. This potentiometer is arranged so that its slider 40 moves in synchronism with the gun in the elevational direction. In the specific example maximum gun elevation is +70°, and minimum gun elevation is −25°; as the gun changes its elevation slider 40 moves to the appropriately numbered location along the potentiometer. Slider 40 is connected to a line 42 that delivers an analog signal voltage to a junction 44. The magnitude of this signal is related to the position of slider 40 and the conditions of relay contacts 35 and 36. Of principal interest is the condition when slider arm 40 is below the −7° elevation. With the gun below −7° elevation the voltage at wiper arm 40 will be at a more negative value when the pop-up command solenoid is energized than when there is no pop-up command. At the instant when the pop-up command is issued the resistive section between −25° and −10° is switched out to provide a low resistance path from the negative reference voltage to the wiper arm; at the same time the resistive section between the +8° and −5° elevation points is switched in. The pop-up command signal thus has the effect of making the slider arm voltage more negative.

Tachometer 46 delivers a second voltage through line 47 that is proportional to actual gun elevation velocity. Diodes 49 and 45 are arranged in parallel with a resistance 2R that connects with junction 44. The junction 44 voltage is applied to a differential amplifier 48 whose output E constitutes an error signal. The error signal is fed back to the gun elevation rate control system (not shown), which produces elevational velocity change that is reflected in a changed output from tachometer 46. The system is designed so that error signal E is at or near zero when the gun elevational velocity is at the value set by the gunner via hand action.

The back-to-back diodes 49 and 45 have breakdown voltages that permit conduction across the diodes in one direction or the other when the signals in lines 42 and 47 are sufficiently out of balance. Therefore the postion of arm 40 (that controls the magnitude of the signal in line 42) controls the maximum value of the tachometer signal under null conditions. In the absence of a pop-up command from solenoid 34 the signal at slider arm 40 tends to force the gun down as the gun moves from +50° toward +70°, and up as the gun moves from −5° toward −25°. In the presence of a pop-up command the signal at slider arm 40 tends to force the gun up in the range between +8° and −10°; at −7° the gun is prevented from downward movement. The slider-potentiometer system 38, in combination with the pop-up command signal system, tends to decelerate and cushion the gun against shock as it approaches the various upper and lower travel limits. Should the gun be at a level below −7° when it approaches avoidance zone 14, then in that situation the voltage generated at arm 40 will indirectly force the gun to the −7° elevation by the time it reaches the avoidance zone. Speed sensor 46 signal will determine the magnitude of the error signal, hence the elevation rate.

The control circuit preferably includes a line 51 connected to azimuth tachometer 28 for delivering a voltage signal to amplifier 53, and thence through line 60 to the turret drive control circuit (not shown). The line 51 signal limits the turret train velocity at the gunner-controlled value (except when the gun is approaching avoidance zone 14). A low turret train acceleration limit is forced on the turret when the weapon approaches the avoidance zone and the weapon is below −7.5° elevation. This limit is imposed so that the gunner cannot suddenly accelerate the turret in the azimuth plane just as he hits the point where the weapon begins to pop-up. This too allows the weapon to stay at lower angles, closer to the interference zone, and provides more low angle coverage. A low azimuth acceleration limit signal is sent back through line 60 to the azimuth rate control (not shown) only when AND gate 50 receives three favorable inputs indicating respectively, the existence of a pop-up command, gun elevation below −7.5°, and gun inertial velocity above some minimum value where the gunner could apply harmful azimuth acceleration inputs to the control system. The three necessary "condition" inputs are delivered to AND gate 50 through lines 52, 54 and 56.

In the illustrative drawing the existence of a pop-up command registers as the closing of normally-open relay contacts 55 controlled by pop-up solenoid 34. Condition of the gun below −7.5° elevation is detected by a voltage-sensitive detector 57 having a connection 58 with the voltage signal 42 leading from slider 40. Gun inertial condition is sensed by a voltage detector 59 having a connection 61 with the azimuth velocity signal line 51. Detector 59 would in practice be set to deliver an output signal through line 56 when the existing turret train rate (sensed by tachometer 28) is above some value, e.g. 5°/second, that could be suddenly increased to a deck-strike condition by gunner overanxiety to reach the target.

Logic 1 or high signals in lines 52, 54 and 56 enable AND gate 50 to energize a controller 62, which thereupon opens the normally-closed contacts 64 and 66. Contacts 64 are located in a line 67 connected to a differential amplifier 68. Amplifier input signals are received from train rate sensor line 51 and train rate limit voltage source 69. The voltage in line 67 is a function of the difference between the train rate limit and existing train rate. This voltage is fed through normally-closed contacts 64 to a storage capacitor 70.

At the instant when contacts 64 and 66 open the stored charge in capacitor 70 is applied to junction 72. This action changes the voltage input to amplifier 53, which then delivers an acceleration-limiting signal to line 60.

The invention relates primarily to the aforementioned pop-up command circuit 22 and the elevation sensor circuit 38. These circuits cooperate with the speed sensors 28 and 46 to regulate the azimuth and elevation velocities during the avoidance zone-approach time periods. Various types of circuit components can be utilized to process the signals into feedback commands E and 60.

I wish it to be understood that I do not desire to be limited to the exact details of construction shown and described for obvious modifications will occur to a person skilled in the art.

I claim:

1. In a military vehicle having a turret rotatable in the azimuth plane and a gun movable in elevational planes, the vehicle providing a localized avoidance zone (14) that obstructs azimuth movement of the gun-turret system when the gun is in its lowest elevational setting:

the combination comprising electric circuit means (22,34) responsive to approach movement of the gun toward the avoidance zone for issuing an electric pop-up command signal; azimuth velocity sensor means (28) electrically interconnected with said circuit means (22,34) for timewise advancing the pop-up command signal directly in accordance with azimuth velocity;

potentiometer means (38) for generating gun-elevating signal when the gun is at or near its minimum elevation setting; elevation velocity sensor means (46) interconnected with said potentiometer means (38) to increase the gun-elevating signal inversely according to sensed elevation velocity;

and contacts (35,36) controlled by the pop-up command signal for shunting the signal voltage around resistive sections of the potentiometer, whereby a gun-elevating signal is generated to force the gun upwardly as it approaches the avoidance zone.

2. In the vehicle of claim 1: the improvement further comprising means (50,62) responsive to pop-up command, minimum gun elevation condition, and azimuth inertial condition, for generating an azimuth rate limit signal.

3. In the vehicle of claim 1: said pop-up command means comprising a potentiometer-slider means (22,24) arranged for relative motion in synchronism with azimuth approach movement of the gun toward the avoidance zone, azimuth speed sensor means (28), and voltage-sensitive detector means (32) receiving voltage signals from the potentiometer-slider means and speed sensor means to dictate the time occurrence of the pop-up command.

* * * * *